US005967885A

United States Patent [19]

Crevasse et al.

[11] Patent Number: 5,967,885

[45] **Date of Patent: *Oct. 19, 1999**

[54] METHOD OF MANUFACTURING AN INTEGRATED CIRCUIT USING CHEMICAL MECHANICAL POLISHING

[75] Inventors: Annette Margaret Crevasse; William Graham Easter; John Albert Maze, III; John Thomas Sowell, all of Orlando, Fla.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/982,109

[22] Filed: Dec. 1, 1997

[51] Int. Cl.[6] ..... B24B 5/00; B24B 29/00

[52] U.S. Cl. ..... 451/285; 451/364; 451/398

[58] Field of Search ..... 451/285, 287, 451/288, 289, 41, 28, 42, 63, 364, 388, 384, 390, 397, 398, 286; 269/56, 57, 21

[56] References Cited

U.S. PATENT DOCUMENTS

| | | | |
|---|---|---|---|
| 3,374,582 | 3/1968 | Boettcher . | |
| 3,627,338 | 12/1971 | Thompson | 451/388 |
| 3,842,544 | 10/1974 | Paola | 51/129 |
| 4,711,610 | 12/1987 | Riehl | 451/388 |
| 5,036,630 | 8/1991 | Kaanta et al. | 451/289 |
| 5,394,655 | 3/1995 | Allen et al. | 451/41 |
| 5,597,346 | 1/1997 | Hempel, Jr. | 451/289 |
| 5,695,392 | 12/1997 | Kim | 451/398 |
| 5,795,215 | 8/1998 | Guthrie et al. | 451/286 |

*Primary Examiner*—David A. Scherbel
*Assistant Examiner*—Derris Holt Banks
*Attorney, Agent, or Firm*—Anthony Grillo

[57] ABSTRACT

A method of manufacturing integrated circuits using a carrier fixture. The carrier fixture does not include transport channels or openings for directing a slurry to a substrate being polished and, as a result, damage to the substrate is reduced because the edges adjacent to the substrate are eliminated. The present invention further provides a carrier fixture having an inner support coupled to a ring member that contacts a substrate during the CMP process. The present invention also provides a carrier fixture having inner and outer supports coupled to a ring member.

8 Claims, 3 Drawing Sheets

METHOD OF MANUFACTURING AN INTEGRATED CIRCUIT USING CHEMICAL MECHANICAL POLISHING

FIELD OF THE INVENTION

The present invention relates generally to chemical mechanical polishing and, more particularly, to chemical mechanical polishing using a carrier fixture.

BACKGROUND OF THE INVENTION

Chemical-Mechanical polishing (CMP) is used extensively in the manufacture of semiconductor devices. An exemplary CMP system is shown in U.S. Pat. No. 5,081,421 entitled IN SITU MONITORING TECHNIQUE AND APPARATUS FOR CHEMICAL/MECHANICAL PLANARIZATION ENDPOINT DETECTION, issued to Miller et al. and dated Jan. 14, 1992. This patent is incorporated herein by reference for its teachings on chemical mechanical polishing. FIGS. 4 and 5 illustrate a substrate 500 positioned in a carrier fixture 510 for chemical mechanical polishing (CMP). The substrate 500 is, for example, a six inch wafer which is produced having a flat edge 502. The carrier fixture 510 is mounted in a chemical mechanical polisher (not shown). The carrier fixture 510 holds the substrate 500 in opening 515 during the CMP process and allows the substrate 500 to rotate. The carrier fixture 510 includes transport channels 520 that allow a slurry to be channeled from the exterior of the carrier fixture 510 to the opening 515 where the substrate 500 is disposed during the CMP process. In other words, the transport channels 520 are openings from the exterior of the carrier fixture 510 to the opening 515. During the CMP process using the carrier fixture 510, the substrate 500 may be damaged and, therefore, must be discarded. Accordingly, it would be advantageous to develop a CMP process that reduces the occurrence of damage to the substrate.

SUMMARY OF THE INVENTION

The present is also directed to a method of manufacturing integrated circuits using a carrier fixture. The carrier fixture does not include transport channels or openings for directing a slurry to a substrate being polished and, as a result, damage to the substrate is reduced because the edges adjacent to the substrate are eliminated. The inventors haste determined that the substrate 500 scores the prior art carrier fixture 510 and has a tendency to catch the edge 525 of the transport channel 520 during the CMP process. For a six inch substrate 500, the flat edge of the substrate has a tendency to catch the edge 525. As a result, the substrate 500 may cleave or break. The present invention further provides a carrier fixture having an inner support coupled to a ring member that contacts a substrate during the CMP process. The present invention also provides a carrier fixture having inner and outer supports coupled to a ring member. It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice in the semiconductor industry, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
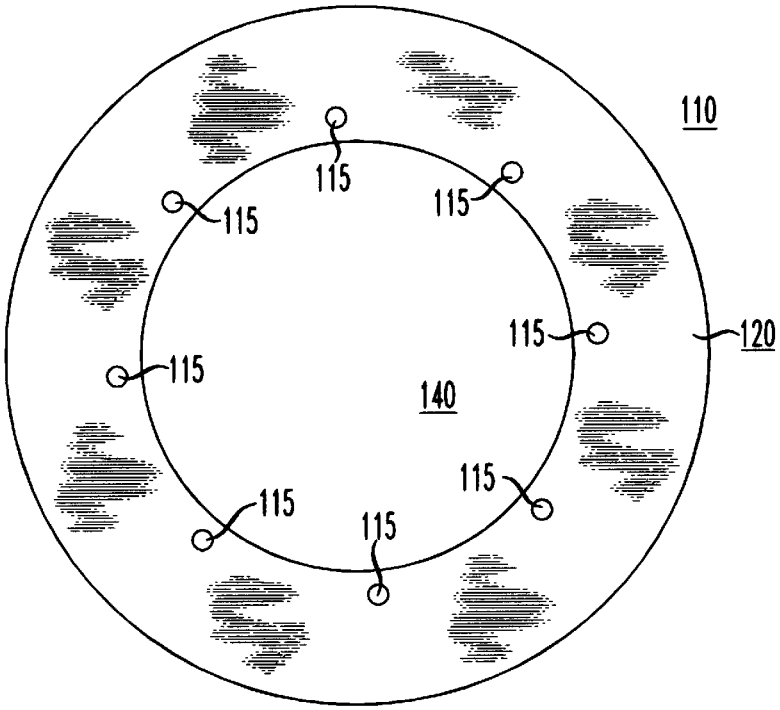
FIG. 1 is a top view of a carrier fixture according to an exemplary embodiment of the present invention.

Referring now to the drawing, wherein like reference numerals refer to like elements throughout, FIG. 1 is a carrier fixture 110 used in a polishing system including a polisher (not shown) that is used during the manufacture of integrated circuits. The polisher is, for example, an Auriga Planarization System, Auriga-C Planarization System, or a CMP 5, each available from Speedfam of 7406 West Detroit, Chandler, Ariz. 85228. The polisher is used to polish a substrate 200, shown in FIG. 2, using, for example, chemical mechanical polishing. During polishing, the substrate 200 is placed in the carrier fixture 110 and polished by applying a slurry and rotating the substrate disposed in the carrier fixture 110. The substrate 200 may be formed from materials such as silicon, germanium, gallium arsenide or other materials known to those skilled in the art. The carrier fixture 110 may be formed from materials such as acetal (known as Delrin™), ceramics, and polyphenyane sulfide.

Figure 2:
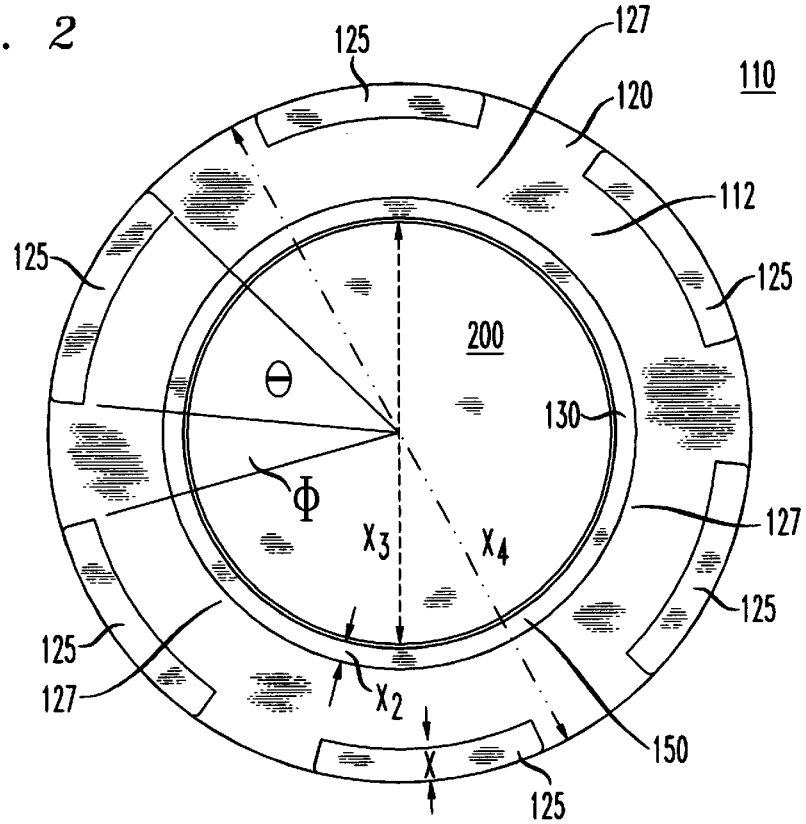
FIG. 2 is a bottom view of the carrier fixture.
Figure 3:
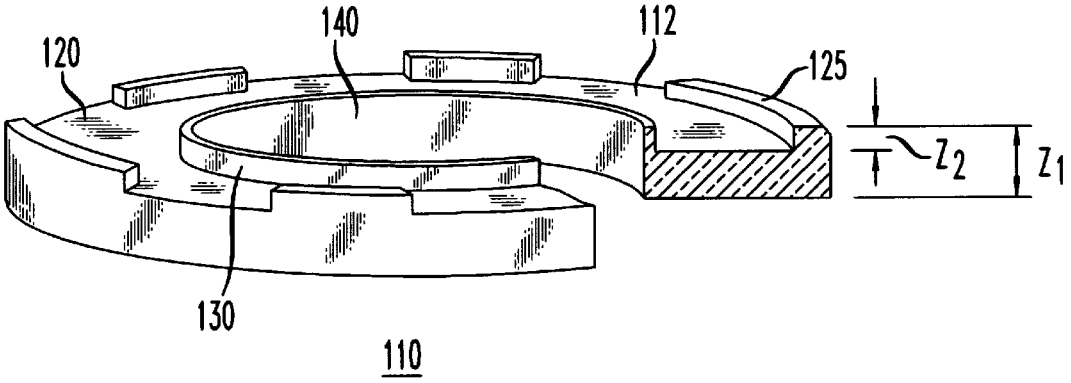
FIG. 3 is a perspective view of the carrier fixture.
Figure 4:
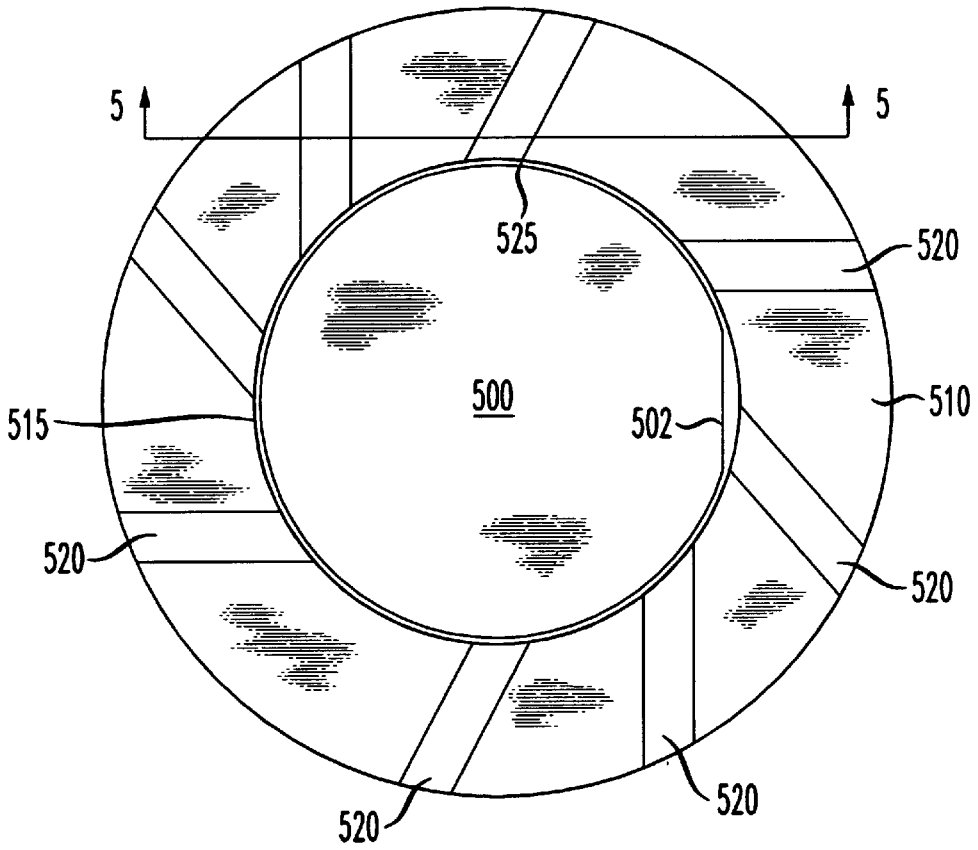
FIG. 4 (PRIOR ART)
FIG. 4 is a bottom view of a carrier fixture according to the prior art.
Figure 5:
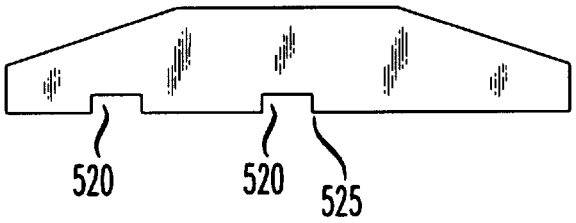
FIG. 5 (PRIOR ART)
FIG. 5 is a schematic diagram of the prior art carrier fixture along line 5—5.

The carrier fixture 110 has openings 115 that receive clips, screws or fasteners (not shown) to attach the carrier fixture 110 to the polisher. As is shown in FIGS. 2 and 3, the bottom 112 of carrier fixture 110 includes a ring member 120 that does not have the above described slurry channels for providing slurry to the substrate 200. It has been found that slurry channels are not necessary for channeling a slurry to the substrate 200 during polishing. A sufficient amount of slurry passes under the inner support 130 to the substrate 200 during polishing.

One or more outer supports 125 are formed on the bottom 112 at the outer area or the periphery of the ring member 120. The outer supports 125 stabilize the ring member 120 during the polishing process. The outer supports 125 are spaced along the outer area so that the slurry may be channeled to the area 127 around an inner support 130. Each outer support 125 extends along an arc of $\theta$ which is, for example, 30°. Each outer support 125 is separated by an area extending along an arc of $\phi$ which is, for example, 30°. The thickness X1 of the outer supports 125 is, for example, 0.25 inches (6.35 mm). The outer supports 125 and the inner support 130 do not form transport channels as in the prior art. The diameter X4 of the ring member 120 is, for example, 8.625 inches (219.08 mm). The diameter X3 of the opening 140 is, for example, 5.975 inches (151.77 mm)

The inner support 130 is on an inner area or inner periphery of the ring member 120. The inner support 130 forms a ring around opening 140. The thickness X2 of the inner support 130 can be decreased to increase its flexibility. Increased flexibility is desirable to avoid damage to the substrate 200 when the substrate 200 contacts the inner support 130 during polishing. The thickness X2 is, for example, 0.25 inches (6.35 mm).

The inner support 130 and the outer supports 125 project above the surface of the ring member 120 substantially the same distance Z2. The distance Z2 is, for example, 0.25 inches (6.35 mm). The height Z1 of the ring member 120 is, for example, 0.45 inches (11.42 mm).

During operation, the substrate 200 is disposed in the carrier fixture 110 in opening 140 for the removal of material formed on the substrate 200 using, for example, chemical mechanical polishing (CMP). Approximately twelve to seventeen percent of the substrate 200 projects beyond the bottom 150 of the inner support 130 during polishing. The material formed on the substrate 200 is, for example, a conductive material, an oxide, silicon, or any other material which may be formed on the substrate 200. A slurry used for polishing a conductive material, which is typically tungsten, comprises an abrasive component and an oxidizer. In an advantageous embodiment, aluminum oxide and ferric nitrate are used as the abrasive and the oxidizer, respectfully, in the slurry. As is known, other slurries may be used to polish other materials such as silicon and oxide.

In the CMP process, the conductive material is removed by a combination of physical, i.e. mechanical abrasion, and chemical, i.e., etching, processes. When the slurry and the polisher's pad (not shown) are pressed onto the conductive material, typically at pressures of approximately 6 to 8 psi, the oxidizing component of the slurry oxidizes the conductive material to form a thin layer of metal oxide. This metal oxide is then readily removed with the slurry's abrasive component as the substrate 200 is rotated with respect to the pad. This process is repeated until the material is removed from the substrate 200.

When the carrier fixture 110 was used in the polisher to polish tungsten formed on substrates 200, no substrate breakage was observed for 725 substrates each chemical mechanical polished for 210 seconds. In comparison, the prior art carrier fixture 510 caused substrate breakage after polishing 500 wafers for only 40 seconds each. In other words, the carrier fixture was used to successfully polish 42% more wafers for an increased duration of 425% as compared to the prior art carrier fixture.

Although the invention has been described with reference to exemplary embodiments, it is not limited to those embodiments. Rather, the appended claims should be construed to include other variants and embodiments of the invention which may be made by those skilled in the art without departing from the true spirit and scope of the present invention.

What is claimed:

1. A method of manufacturing an integrated circuit comprising the steps of:

(a) providing a substrate; and (b) placing the substrate in a ring member having an inner area, an outer area, an outer support formed on the outer area, and an inner support formed on the inner area, wherein the inner support is a continuous annular ring.

2. The method of claim 1 further comprising the step of (c) polishing the substrate.

3. The method of claim 1 wherein the ring member has a first surface and the outer support and the inner support are formed on the first surface.

4. The method of claim 3 wherein the inner support and the outer support project above the first surface substantially the same distance.

5. The method of claim 1 wherein the inner support forms a ring.

6. The method of claim 1 further comprising a plurality of outer supports.

7. The method of claim 1 wherein the outer support is separate from the inner support.

8. A method of manufacturing an integrated circuit comprising the steps of:

(a) providing a substrate; and (b) placing the substrate in an annular ring member comprising an inner support without transport channels.

* * * * *